US008668354B2

(12) United States Patent
Roth et al.

(10) Patent No.: US 8,668,354 B2
(45) Date of Patent: Mar. 11, 2014

(54) LOW-GLARE LED-BASED LIGHTING UNIT

(75) Inventors: Eric Anthony Roth, Tyngsboro, MA (US); Sarah Bazydola, Belmont, MA (US)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/513,870

(22) PCT Filed: Nov. 22, 2010

(86) PCT No.: PCT/IB2010/055332

§ 371 (c)(1), (2), (4) Date: Jul. 27, 2012

(87) PCT Pub. No.: WO2011/073828

PCT Pub. Date: Jun. 23, 2011

(65) Prior Publication Data

US 2012/0281405 A1 Nov. 8, 2012

Related U.S. Application Data

(60) Provisional application No. 61/286,140, filed on Dec. 14, 2009.

(51) Int. Cl.
*F21V 5/00* (2006.01)

(52) U.S. Cl.
USPC ..... 362/244; 362/294; 362/335

(58) Field of Classification Search
USPC ..... 362/244, 294, 373, 335
See application file for complete search history.

(56) References Cited

U.S. PATENT DOCUMENTS

| | | | | |
|---|---|---|---|---|
| 7,534,015 | B2 | 5/2009 | Xu et al. | |
| 2002/0122309 | A1 * | 9/2002 | Abdelhafez et al. | 362/294 |
| 2005/0068765 | A1 | 3/2005 | Ertze Encinas et al. | |
| 2009/0103294 | A1 | 4/2009 | Zhang et al. | |
| 2009/0147521 | A1 | 6/2009 | Zhang et al. | |
| 2009/0262530 | A1 | 10/2009 | Tickner et al. | |

FOREIGN PATENT DOCUMENTS

| | | | |
|---|---|---|---|
| CN | 2847010 | Y | 12/2006 |
| JP | 2009016058 | | 1/2009 |
| WO | 02066889 | A1 | 8/2002 |

* cited by examiner

*Primary Examiner* — Joseph L Williams
(74) *Attorney, Agent, or Firm* — Mark L. Beloborodov

(57) ABSTRACT

The present disclosure is directed to inventive methods and apparatus for a low-glare LED-based lighting unit (110). The low-glare LED-based lighting unit (110) may have vertically extending LED support structure (120) and an array of individually aimed LEDs (133) coupled to the vertically extending LED support structure (120). At least one vertically extending translucent inner lens (150/260) may be provided adjacent a plurality of the LEDs (133) and intersect the LED light output axis (A) of a plurality of the LEDs (133).

18 Claims, 7 Drawing Sheets

LOW-GLARE LED-BASED LIGHTING UNIT

TECHNICAL FIELD

The present invention is directed generally to a low-glare lighting unit employing solid-state light sources. More particularly, various inventive methods and apparatus disclosed herein relate to a low-glare LED-based lighting unit that may be installed in a lighting fixture for illuminating a selected illumination area.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting unit, including one or more LEDs capable of producing different colors, e.g. red, green, and blue, as well as a processor for independently controlling the output of the LEDs in order to generate a variety of colors and color-changing lighting effects.

Many lighting fixtures have been designed that implement LEDs to reap one or more of the advantages and benefits of LEDs. For example, some outdoor LED street lighting fixtures have been designed that enclose a plurality of LEDs in a shoe-box type housing, with the LEDs being in a generally horizontally planar configuration and generally aimed toward a desired illumination area. While such lighting fixtures may provide a high light output efficiency, they also produce a large amount of perceived glare to a pedestrian who may be traveling (e.g. in a car, walking, riding a bike) in the proximity of the illumination area. The glare may be non-aesthetically pleasing, discomforting, and/or even dangerous to a pedestrian.

Some LED street lighting fixtures have been designed that attempt to remedy glare from LEDs by aiming all of the LEDs away from the desired illumination area and redirecting light output from the LEDs toward the desired illumination area. The redirection may occur through, for example, use of a redirecting optical lens affixed over and immediately adjacent a single LED and/or one or more redirecting reflectors. While such lighting fixtures may help lessen the amount of glare, they may not lessen the glare sufficiently and/or may also diminish the light output efficiency of the lighting fixture through one or more light output reflections. Moreover, such lighting fixtures may require reflectors and/or optical lenses therein to be specifically designed to achieve a desired light output, thereby requiring a distinct reflector and/or optical lens for each distinct light output.

Thus, there is a need in the art for a low-glare LED-based lighting unit having a vertically extending array of individually aimed LEDs and at least one translucent inner lens provided adjacent a plurality of the LEDs and intersecting the LED light output axis of a plurality of the LEDs, thereby reducing perceived glare emitted from the LED-based lighting unit.

SUMMARY

The present disclosure is directed to inventive methods and apparatus for a low-glare LED-based lighting unit, and, more specifically, a low-glare LED-based lighting unit having vertically extending individually aimed LEDs and at least one translucent inner lens provided adjacent a plurality of the LEDs. For example, the low-glare LED-based lighting unit may have a vertically extending LED support structure and an array of LEDs coupled thereto, a plurality of the LEDs being efficiently individually aimed toward a desired illumination area. At least one translucent inner lens may be provided adjacent a plurality of the LEDs and intersect the LED light output axis of a plurality of the LEDs, thereby reducing perceived glare emitted from the lighting unit. The at least one translucent inner lens may optionally comprise at least one vertically extending inner lens slat adjacent a plurality of the LEDs and/or a generally cylindrical inner lens surrounding a plurality of the LEDs. Optionally, the LED-based lighting unit may be installable within an outer housing of a post-top street lighting fixture for illuminating an illumination area. The LED-based lighting unit may be configured for producing a desired light output such as, for example, Illuminating Engineering Society (IES) Type I, II, Ill, IV, and/or V light output.

Generally, in one aspect, an LED-based lighting fixture for illuminating an illumination area includes vertically extending LED support structure and an array of LEDs coupled to the LED support structure. A plurality of the LEDs have an LED light output axis that is aimed toward the illumination area. The LED-based lighting fixture further comprises an outer housing that surrounds the LED support structure. At least a portion of the outer housing allows for the passage of light output therethrough. The LED-based lighting fixture further comprises a plurality of optical pieces each substantially adjacent a single of the LEDs and intersecting the LED light output axis of a single of the LEDs. The LED-based lighting fixture further comprises at least one vertically extending translucent inner lens interposed between a plurality of the optical pieces and the outer housing. The inner lens intersects the LED light output axis of a plurality of the LEDs.

In some embodiments, the vertically extending LED support structure includes a plurality of vertically extending LED support strips. In some versions of these embodiments each of the vertically extending LED support strips includes a plurality of mounting surfaces generally facing the illumination area.

In some embodiments, the at least one vertically extending inner lens includes a plurality of vertically extending lens slats. In some versions of these embodiments the array of individually positioned LEDs includes a plurality of vertically extending columns of LEDs. In some versions of these embodiments at least one of the lens slats is interposed between only a single of the vertically extending columns and the outer housing. The at least one vertically extending inner lens may include a substantially cylindrical lens surrounding the LEDs.

In some embodiments a plurality of the optical pieces are each surrounded by a middle section that also surrounds a single of the LEDs. In some versions of these embodiments a plurality of the optical pieces are each sandwiched between a portion of the middle section and a portion of a top coupled to the middle section. Optionally, the top may be threadedly coupled to the middle section.

Generally, in another aspect, an LED-based lighting unit installable within an outer housing of a post-top street lighting fixture for illuminating an illumination area is provided. The LED-based lighting unit comprises vertically extending LED support structure, an array of individually aimed LEDs coupled to the LED support structure, and a plurality of vertically extending translucent inner lens slats. The majority of the LEDs have an LED light output axis aimed toward the illumination area. Each of a plurality of the inner lens slats are substantially adjacent a plurality of the LEDs and intersect the LED light output axis of a plurality of the LEDs.

In some embodiments the vertically extending LED support structure comprises a plurality of vertically extending LED support strips. In some versions of these embodiments the array of individually positioned LEDs includes a plurality of vertically extending columns of LEDs. In some versions of these embodiments at least one of the inner lens slats is intersecting the LED light output axis from the LEDs belonging to only a single of the vertically extending columns.

In some embodiments, a first inner lens slat of the vertically extending inner lens slats has a first predetermined configuration and a second inner lens slat of the vertically extending inner lens slats has a second predetermined configuration distinct from the first predetermined configuration. In some versions of these embodiments the first inner lens slat is a different color than the second inner lens slat. In some versions of these embodiments the first inner lens slat has different light path alteration characteristics than the second inner lens slat.

Generally, in another aspect, an LED-based lighting unit installable within an outer housing of a post-top street lighting fixture for illuminating an illumination area is provided. The LED-based lighting unit comprises vertically extending LED support structure, an array of individually aimed LED nodes coupled to the LED support structure, and a translucent substantially cylindrical inner lens surrounding the LED nodes. Each of the LED nodes have a sealingly enclosed LED having a light output axis A. A majority of the LEDs have their light output axis aimed toward the illumination area. The inner lens intersects the LED light output axis of a majority of the LEDs.

In some embodiments, a plurality of the LED nodes each have a middle section surrounding a single of the LED and a top removably coupled to the middle section. In some versions of these embodiments, a plurality of the LED nodes each have an optical piece, a flange of the optical piece being sandwiched between a portion of the middle section and a portion of the top.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

The term "controller" is used herein generally to describe various apparatus relating to the operation of one or more light sources. A controller can be implemented in numerous ways (e.g., such as with dedicated hardware) to perform various functions discussed herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs).

In various implementations, a processor or controller may be associated with one or more storage media (generically referred to herein as "memory," e.g., volatile and non-volatile computer memory such as RAM, PROM, EPROM, and EEPROM, floppy disks, compact disks, optical disks, magnetic tape, etc.). In some implementations, the storage media may be encoded with one or more programs that, when executed on one or more processors and/or controllers, perform at least some of the functions discussed herein. Various storage media may be fixed within a processor or controller or may be transportable, such that the one or more programs stored thereon can be loaded into a processor or controller so as to implement various aspects of the present invention discussed herein. The terms "program" or "computer program" are used herein in a generic sense to refer to any type of computer code (e.g., software or microcode) that can be employed to program one or more processors or controllers.

The term "vertically extending" is used herein to refer to an implementation or arrangement of structure that extends at a zero to forty-five degree angle with respect to nadir of a lighting fixture. The vertically extending structure may contain one or more segments that are horizontal or at an angle between horizontal and vertical, but the structure, as a whole, extends at a zero to forty-five degree angle with respect to nadir of a lighting fixture It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
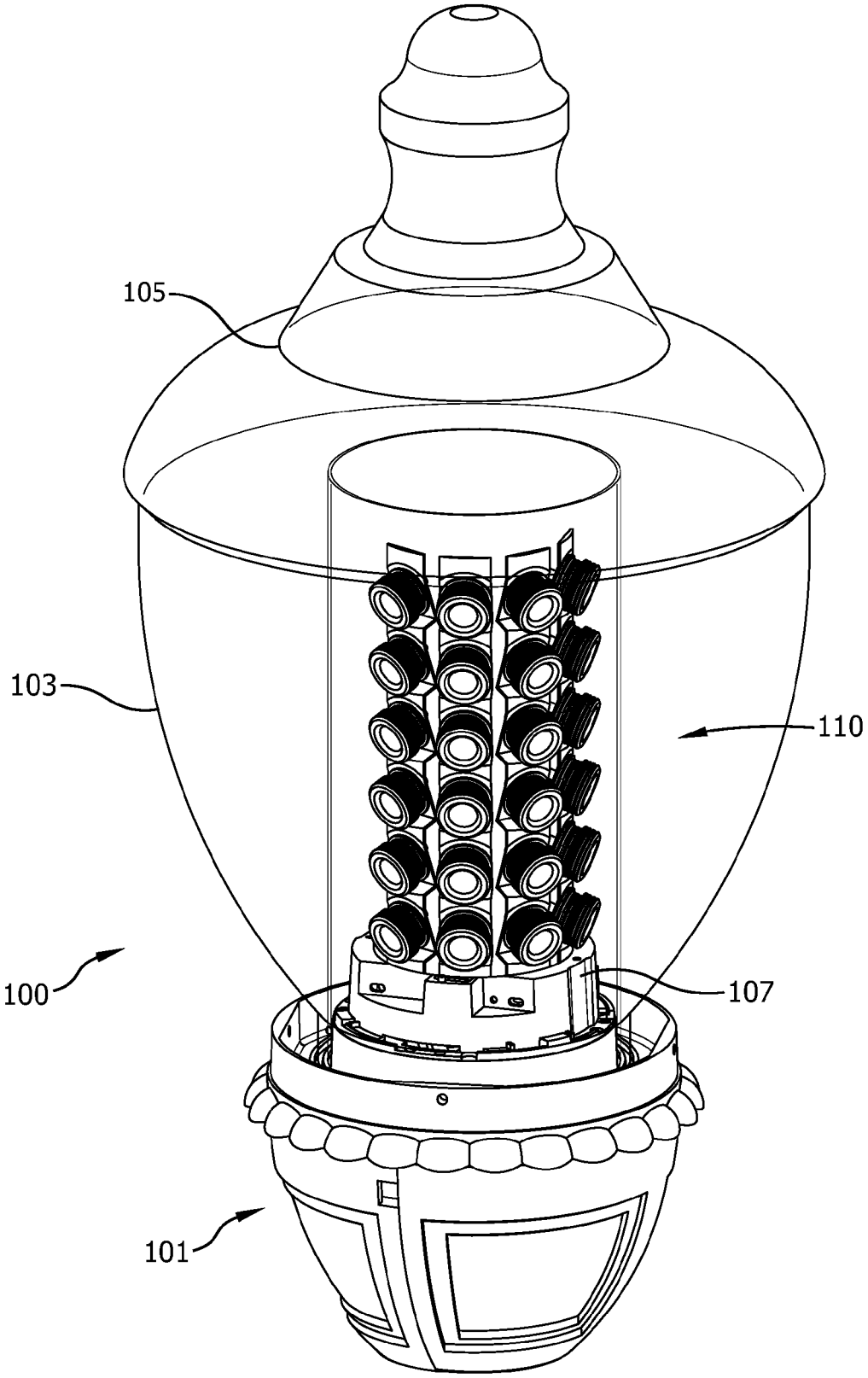
FIG. 1 illustrates a post-top lighting fixture having a first embodiment of a low-glare LED-based lighting unit installed therein.

Various lighting fixtures have been designed that implement a LED light source. An LED light source has many known benefits, but often produces a large amount of glare due to the general "point-source" nature of LEDs. Some LED-based street lighting fixtures have been designed that attempt to remedy glare from LEDs by aiming all of the LEDs away from the desired illumination area and redirecting light output from the LEDs toward the desired illumination area utilizing one or more redirecting optical lenses and/or redirecting reflectors. While such lighting fixtures may help lessen the amount of glare, they may not diminish the glare sufficiently, may diminish the efficiency of the lighting fixture, and/or may require distinct reflector and/or optical lens for each distinct light output. Thus, applicants have recognized and appreciated that it would be beneficial to have a low-glare LED-based lighting unit having vertically extending individually aimed LEDs and at least one translucent inner lens provided adjacent a plurality of the LEDs. For example, the low-glare LED-based lighting unit may have a vertically extending LED support structure and an array of LEDs coupled thereto, a plurality of the LEDs being efficiently individually aimed toward a desired illumination area. At least one translucent inner lens may be provided adjacent a plurality of the LEDs and intersect the LED light output axis of a plurality of the LEDs, thereby reducing perceived glare emitted from the LED-based lighting unit.

More generally, Applicants have recognized and appreciated that it would be beneficial to have a low-glare LED-based lighting unit that employs solid state light sources and at least one inner lens, and that may be installed in a lighting fixture for illuminating a selected illumination area.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the claimed invention. For example, various embodiments of the approach disclosed herein are particularly suited for a low-glare LED-based lighting unit installable in an outdoor post-top lighting fixture and configured to provide predetermined light output characteristics based on the installation location of the post-top lighting fixture. Accordingly, for illustrative purposes, the claimed invention is discussed in conjunction with such a post-top lighting fixture. However, other configurations and applications of this approach are contemplated without deviating from the scope or spirit of the claimed invention.

Figure 2:
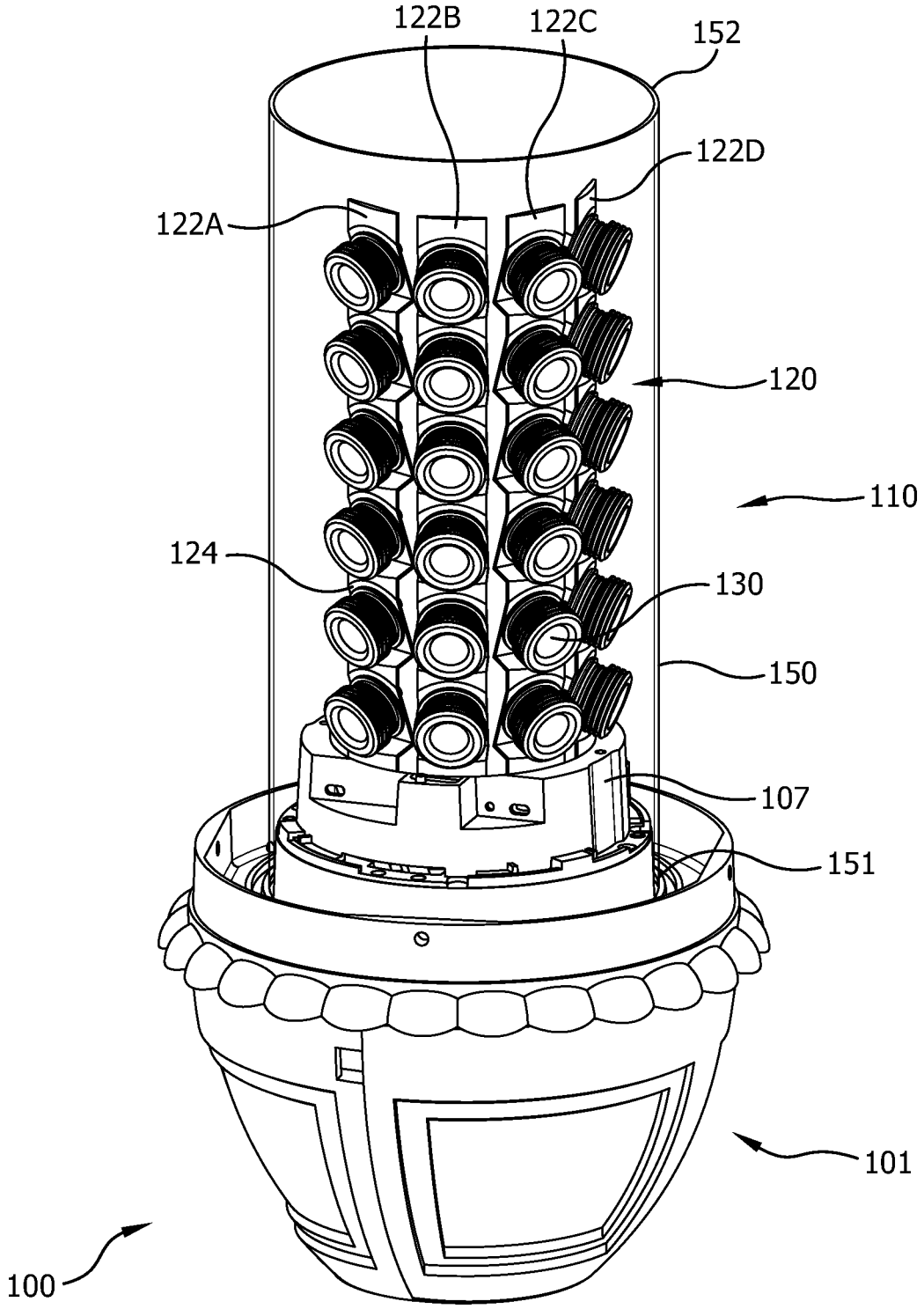
FIG. 2 illustrates the post-top lighting fixture and LED-based lighting unit of FIG. 1, with the globe of the post-top lighting fixture of FIG. 1 removed.

Referring to FIG. 1 and FIG. 2, a first embodiment of a low-glare LED-based lighting unit 110 is shown installed in and forming part of a post-top lighting fixture 100. The post-top lighting fixture 100 includes a base 101. The base 101 may optionally be installed atop a support pole extending from the ground or other surface. The base 101 supports an LED driver cover 107 that encloses at least one LED driver. The LED driver cover 107 may optionally be removably coupled to the base 101. The base 101 also supports an acorn style globe 103, shown in FIG. 1 coupled to the base 101. The globe 103 is not shown in FIG. 2 to more clearly show the LED-based lighting unit 110. The globe 103 may optionally be substantially sealably retained by base 101, forming a chamber substantially sealed from the external environment. The globe 103 may optionally be configured to help achieve a given light distribution pattern and may be provided with, for example, a refractive surface, prismatic surface, and/or an asymmetric reflector adjacent thereto, if desired for a particular application. The globe 103 may be wholly or partially transparent and/or translucent. In the depicted embodiment the globe 103 defines an outer housing and a light output opening of the lighting fixture 100. The globe 103 has an integrally formed decorative top portion 105. In some embodiments, the top portion 105 may optionally be separable from globe 103 and/or may optionally be opaque.

The post-top lighting fixture 100 is depicted for illustrative purposes and, as made apparent from the present description, the LED-based lighting unit 110 may be used with or adapted for use with a variety of other lighting fixtures including, but not limited to, other post-top lighting fixtures. For example, the LED-based lighting unit 110 may be used with or adapted for use with other post-top lighting fixtures having varied base, globe, and/or LED driver cover, and/or top configurations. For example, the globe 103 may have a plurality of light output openings separated from one another by opaque structure and the light output openings may each optionally have an outer translucent lens provided thereover. Also, the LED-based lighting unit 110 may be used to retrofit a variety of lighting fixtures including, but not limited to, existing post-top lighting fixtures.

The globe 103 surrounds the LED-based lighting unit 110. The LED-based lighting unit 110 has vertically extending LED support structure 120. The LED support structure 120 includes four vertically extending LED support strips 122A-D arranged in a generally semi-circle orientation with respect to one another. Each of the LED support strips 122A-D is coupled to the LED driver cover 107 and extends vertically upward therefrom. In some embodiments the LED driver cover 107 may have predetermined attachment areas each allowing an individual of LED support strips 122A-D to be attached thereto. A desired amount of support strips 122A-D may be attached to some of the attachment areas to arrange the support strips 122A-D appropriately for achieving a desired light output. Each of the LED support strips 122A-D has six LED mounting surfaces 124 that are aimed generally downward toward an illumination area at an approximately ten to forty-five degree angle with respect to an upward vertical direction. In alternative embodiments one or more of the mounting surfaces 124 may be manufactured to be at an alternative orientation (e.g. pitch, yaw, and/or roll) than illustrated in FIG. 2 as desired for particular light distribution needs.

Figure 7:
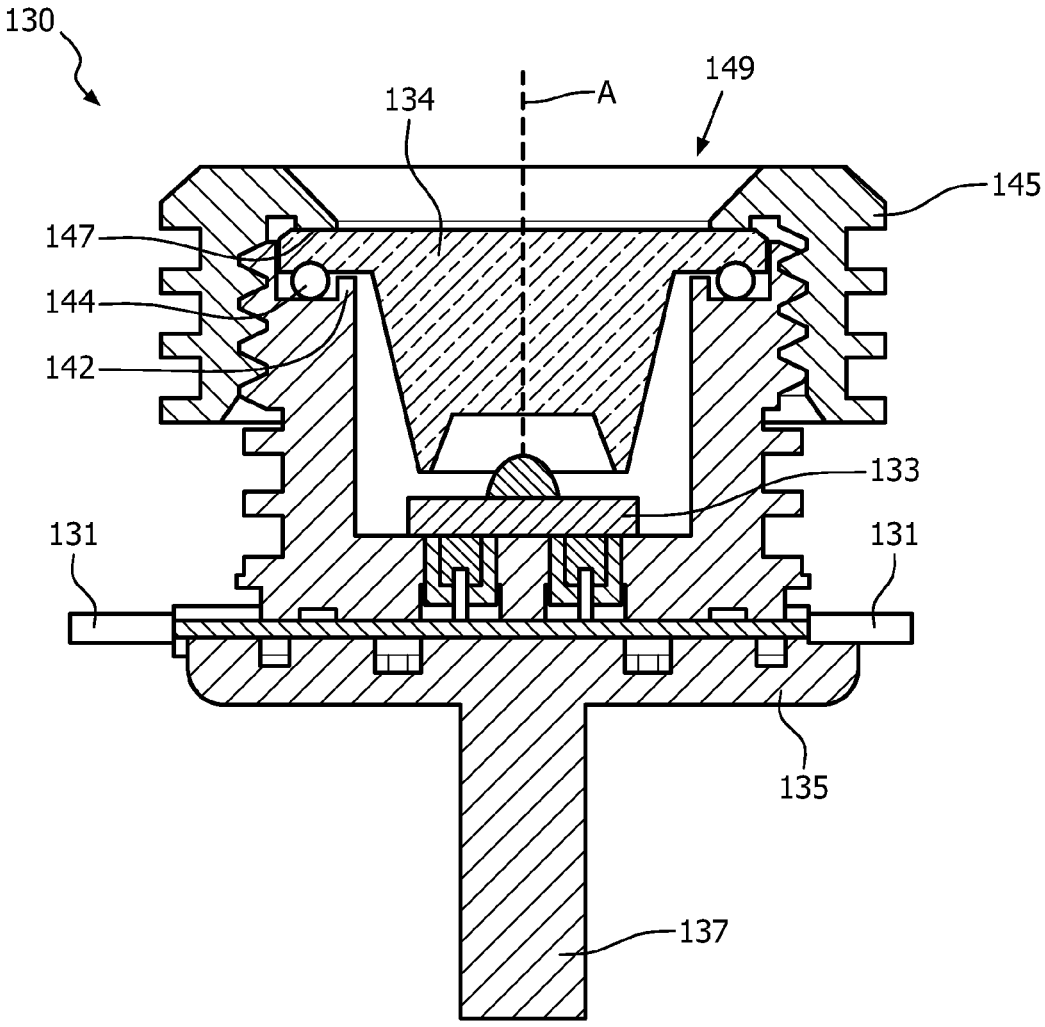
FIG. 7 illustrates a side sectional view of the LED node of FIG. 5 taken along the section line 7-7 of FIG. 5.

Each of the mounting surfaces 124 has an LED node 130 coupled thereto. Referring briefly to FIG. 7, each of the LED nodes 130 has an LED 133 having an LED light output axis A. The LED light output axis A is an axis emanating from the light emitting portion of the LED 133 and generally corresponding to the center of the viewing angle of the LED 133. For example, in the case of an LED mounted on a flat surface and having a lambertian light distribution, the LED light output axis would be substantially perpendicular to the flat surface. In the depicted embodiment, each LED node 130 is coupled to a corresponding mounting surface 124 such that the LED light output axis A thereof is substantially perpendicular to the corresponding mounting surface 124 and aimed toward the illumination area. In alternative embodiments one or more LED node 130 may be coupled to a corresponding mounting surface such that the LED light output axis A thereof is not perpendicular to a corresponding mounting surface 124. Thus, each LED node 130 may be individually aimed through orientation of each mounting surface 124 and/or through appropriate orienting of the LED node 130 with respect to the mounting surface 124 when coupling the LED node 130 thereto.

The depicted LED support structure 120 is configured for IES full cut-off Type III distribution. In alternative embodiments of the LED-based lighting unit 110 the LED support structure 120 may vary in one or more respects. For example, in alternative embodiments more LED support strips 122A-D and corresponding LED nodes 130 may be provided to achieve an alternative light distribution pattern. Additional LED support strips may be placed, for example, in a continuing semi or full circle shape with respect to LED support strips 122 A-D. Also, for example, in alternative embodiments the vertically oriented support strips 122A-D may include heat dissipating structure such as, for example, a plurality of heat fins and/or one or more heat pipes coupled thereto. Also, for example, in alternative embodiments the LED support structure 120 may comprise a plurality of horizontally oriented support strips vertically offset from one another. Also, for example, in alternative embodiments the LED support structure 120 may comprise a single integrally formed vertically extending sheet metal frame having a plurality of mounting surfaces thereon such as, for example, support structure 420 shown in FIG. 8.

A vertically extending translucent cylindrical inner lens 150 surrounds the LED support structure 120 and the LED nodes 130. The inner lens 150 has an inner lens first end 151 adjacent the base 101 and an inner lens second end 152 that is positioned vertically upward of the upward most LED nodes 130. The inner lens 150 is spaced apart from the LED nodes 130 and is surrounded by the globe 103 of the post-top lighting fixture 100. The inner lens 150 reduces the amount of glare visible to a user from LED nodes 130. In FIG. 1 and FIG. 2 the inner lens 150 is depicted as being substantially transparent. In alternative embodiments, the inner lens 150 may be translucent. In some embodiments the inner lens 150 may be provided with one or more rough surfaces to reduce the amount of perceived glare from the LED nodes 130. For example, the inner lens 150 may be provided with a prismatic surface. In some embodiments the inner lens 150 may be colored to alter the perceived color of light emitted by the LED nodes 130. In alternative embodiments, the inner lens 150 may be polygonal, such as for example, rectangular, triangular, or a substantially cylindrical polygon. Design considerations such as, for example, light output efficiency and perceived glare will enable one skilled in the art, having had the benefit of the present disclosure, to selectively vary one or more characteristics of the inner lens 150 to achieve a light output having desired characteristics.

Figure 3:
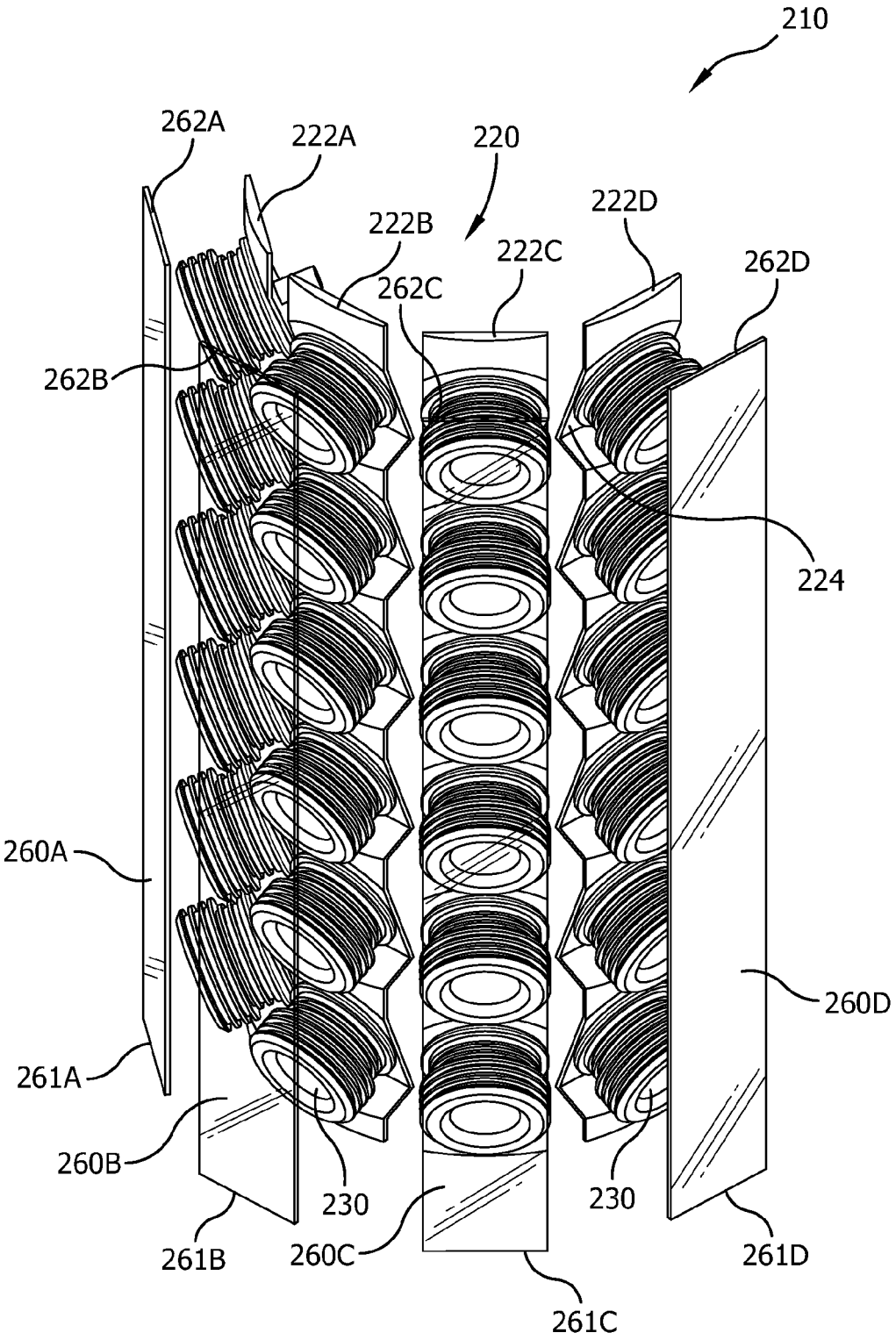
FIG. 3 illustrates a second embodiment of a low-glare LED-based lighting unit.

Referring to FIG. 3, a second embodiment of a low-glare LED-based lighting unit 210 is shown. The LED-based lighting unit 210 may be used with or adapted for use with a variety of other lighting fixtures including, but not limited to, other post-top lighting fixtures. The LED-based lighting unit 210 has vertically extending LED support structure 220. The LED support structure 220 includes four vertically extending LED support strips 222A-D arranged in a generally semi-circle orientation with respect to one another. Each of the LED support strips 222A-D may be coupled to structure within a lighting fixture and be vertically extending within the lighting fixture. For example, in some embodiments the LED support strips 222A-D could be coupled to LED driver cover 107 of FIG. 1 and FIG. 2. Each of the LED support strips 222A-D has six LED mounting surfaces 224 that are aimed generally downward toward an illumination area at an approximately ten to forty-five degree angle with respect to an upward vertical direction. In alternative embodiments one or more of the mounting surfaces 224 may be manufactured to be at an alternative orientation (e.g. pitch, yaw, and/or roll) than illustrated in FIG. 3 as desired for particular light distribution needs.

Each of the mounting surfaces 224 has an LED node 230 coupled thereto such that the LED light output axis A thereof is substantially perpendicular to the corresponding mounting surface 224 and aimed toward the illumination area. In alternative embodiments one or more LED node 230 may be coupled to a corresponding mounting surface such that the LED light output axis A thereof is not perpendicular to a corresponding mounting surface 224. The LED support structure 220 is configured for IES full cut-off Type III distribution.

A plurality of vertically extending inner lens slats 260A-D are each provided adjacent a single vertically extending column of LED nodes 230. The inner lens slats 260A-D have inner lens slat first ends 261A-D and inner lens slat second ends 262A-D positioned vertically upward of the upward most LED nodes 230. Each of the inner lens slats 260A-D is spaced apart from the LED nodes 230. The inner lens slats 260A-D may be coupled to structure within a lighting fixture and be vertically extending within the lighting fixture. For example, in some embodiments the inner lens slats 260A-D may be coupled to the LED driver cover 107 of the FIG. 1 and FIG. 2 and/or to respective of LED support strips 222A-D. The inner lens slats 260A-D reduce the amount of glare visible to a user from LED nodes 230.

In FIG. 3, the inner lens slats 260B and 260C are depicted as being substantially transparent and the inner lens slats 260A and 260D are depicted as being translucent. In some embodiments, each of the inner lens slats 260A-D may have the same configuration. In other embodiments one or more of the inner lens slats 260A-D may vary in one or more respects from other of the inner lens slats 260A-D. For example, one or more of the inner lens slats 260A-D may be provided with a prismatic surface, may be colored, and/or may be more or less translucent than other of the inner lens slats 260A-D. Also, for example, one or more of the inner lens slats 260A-D may be dimensioned differently than those depicted in FIG. 3. The inner lens slats 260 A-D may be dimensioned, for example, vertically shorter to cover less than all of the LED nodes 230 in a given column and/or horizontally wider to cover more than a single column of LED nodes 230. Design considerations such as, for example, light output efficiency and perceived glare will enable one skilled in the art, having had the benefit of the present disclosure, to selectively vary one or more characteristics of the inner lens slats 260A-D to achieve a light output having desired characteristics.

Figure 4:
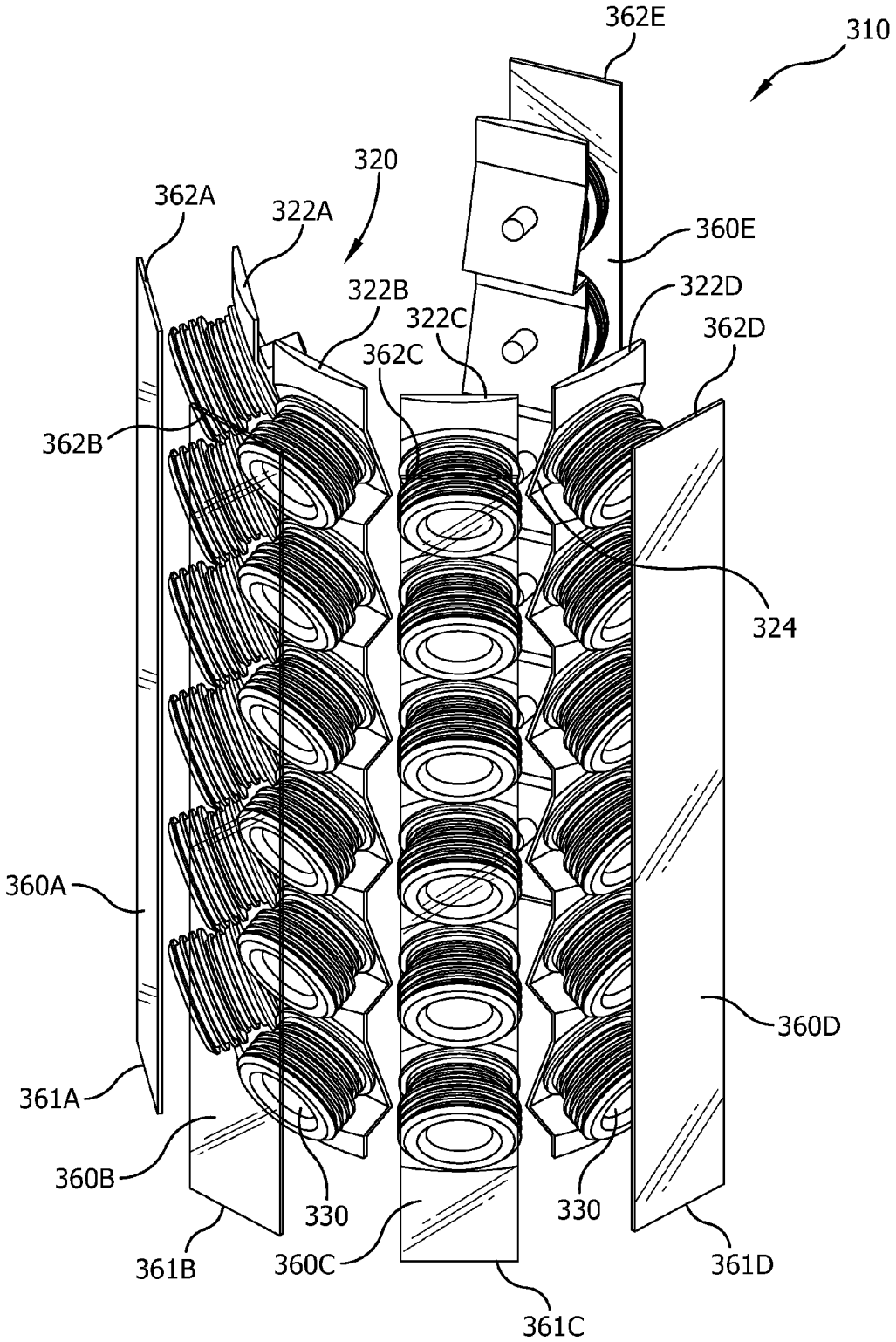
FIG. 4 illustrates a third embodiment of a low-glare LED-based lighting unit.

Referring to FIG. 4, a third embodiment of a low-glare LED-based lighting unit 310 is shown. The third embodiment of the low-glare LED-based lighting unit 310 is similar to the LED-based lighting unit 210, but is provided with an additional LED support strip 322E, additional LED nodes 320 on the LED support strip 322E, and an additional inner lens slat 360E. The LED nodes 320 on the LED support strip 322E face a direction that is distinct from the direction being faced by the LED nodes 320 on the LED support strips 322A-D. The inner lens slat 360E is provided adjacent the LED support strip 322E and inner lens slats 360A-D are provided adjacent respective of the LED support strips 322A-D. In some embodiments the inner lens slat 360E is a non-white color and inner lens slats 360A-D are substantially colorless. In those embodiments the LED-based lighting unit 310 may be installed in a street-lighting fixture adjacent a street, with the inner lens slat 360E facing away from the street, thereby allowing for white light on the street side of the street lighting fixture and a different color on the "back side" of the street lighting fixture. In those and other embodiments a controller may be implemented in communication with the LED-based street lighting unit 310 to selectively illuminate the back side of the street lighting fixture. For example, the controller may only illuminate the back side of the street lighting fixture during certain times of the day and/or during certain times of the year. In some embodiments the lens slat 360E may be easily interchanged with a lens slat having a different color to enable the back side lighting to correspond with an event. In some embodiments the LED nodes 320 on the LED support strip 322E may additionally or alternatively emit a different color of light than the LED nodes 320 on the LED support strips 322A-D.

Figure 5:
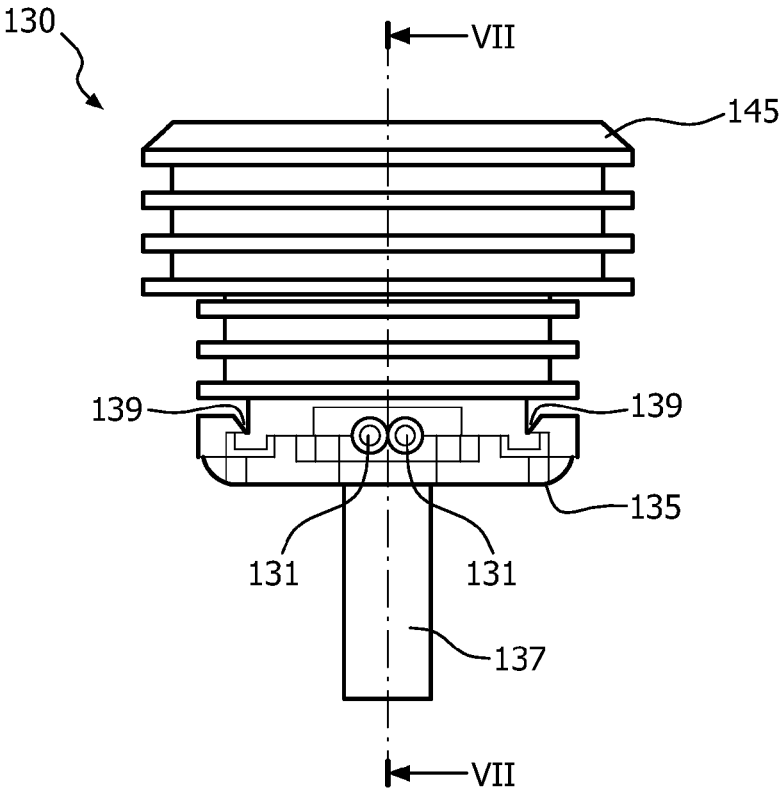
FIG. 5 illustrates a side view of a LED node of the first embodiment of the low-glare LED-based lighting unit.
Figure 6:
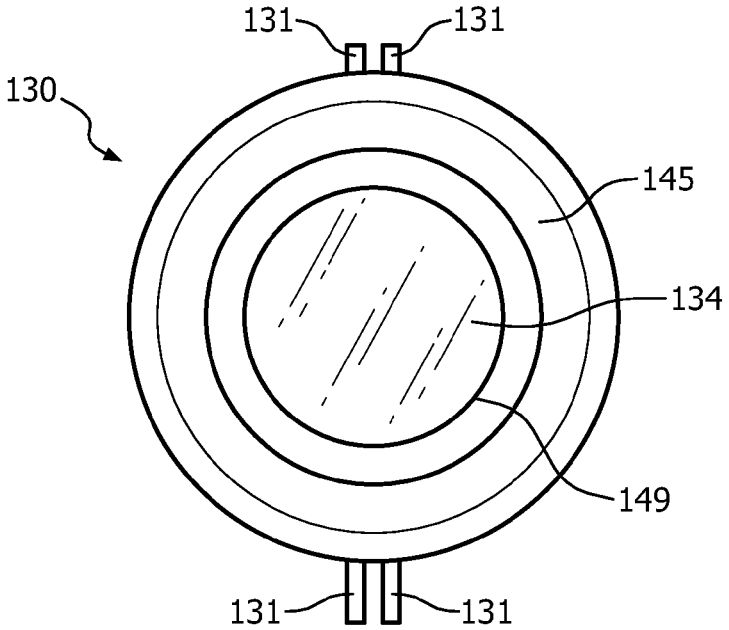
FIG. 6 illustrates a top view of the LED node of FIG. 5.

Referring to FIG. 5 through FIG. 7, an embodiment of LED node 130 is described in additional detail. LED node 130 includes a base 135 coupled to a middle section 140 and a top 145 coupled to the middle section 140. The base 135 has protuberances 139 that engage corresponding structure on middle section 140, thereby coupling base 135 to middle section 140. In alternative embodiments, base 135 and middle section 140 may be coupled to one another using alternative connection mechanisms such as, for example, clips, threaded connection, adhesive, molding the two parts together, and/or welding. A projection 137 extends outwardly from base 135 and may be utilized to help appropriately orient LED node 130 on LED support structure 120 and/or may be utilized to help affix LED node 130 to LED support structure 120. Electrical wiring 131 extends between portions of the base 135 and the middle section 140 and is electrically connected to an LED 133 within middle section 140.

An optical piece 134 is adjacent the LED 133 and the light output axis A of the LED 133 extends through the optical piece 134. A majority of the light outputted by the LED 133 will pass through the optical piece 134 and exit the LED node 130. The optical piece 134 has a flange that is sandwiched between a gasket 144 adjacent a middle section lip 142 of the middle section 140 and a contact portion 147 of the top housing 145. In some embodiments caulking may be added proximal contact portion 147 and optical piece 134. The top housing 145 is threadedly coupled to the middle section 140. In alternative embodiments, top housing 145 and middle section 140 may be coupled to one another using alternative connection mechanisms such as, for example, clips, threaded connection, adhesive and/or welding. The optical piece 134 and the middle section 140 collectively enclose and seal the LED 133.

The top housing 145 includes a top housing opening 149 sized to allow light emitted from LED 133 and passing through optical piece 134 to exit LED node 130. The opening 149 may optionally be provided with a lens thereover. Optionally, the optical piece 134 may be omitted and a lens may be provided over the opening 149 and the top housing 145 and the middle section would collectively enclose and seal the LED 133. Optionally, alternative optical pieces 134 may be may be used in one or more LED nodes 130 in an LED module 110 to achieve a desired light output from a given LED node 130. In various embodiments the LED node 130 may achieve an ingress protection rating of 66.

Figure 8:
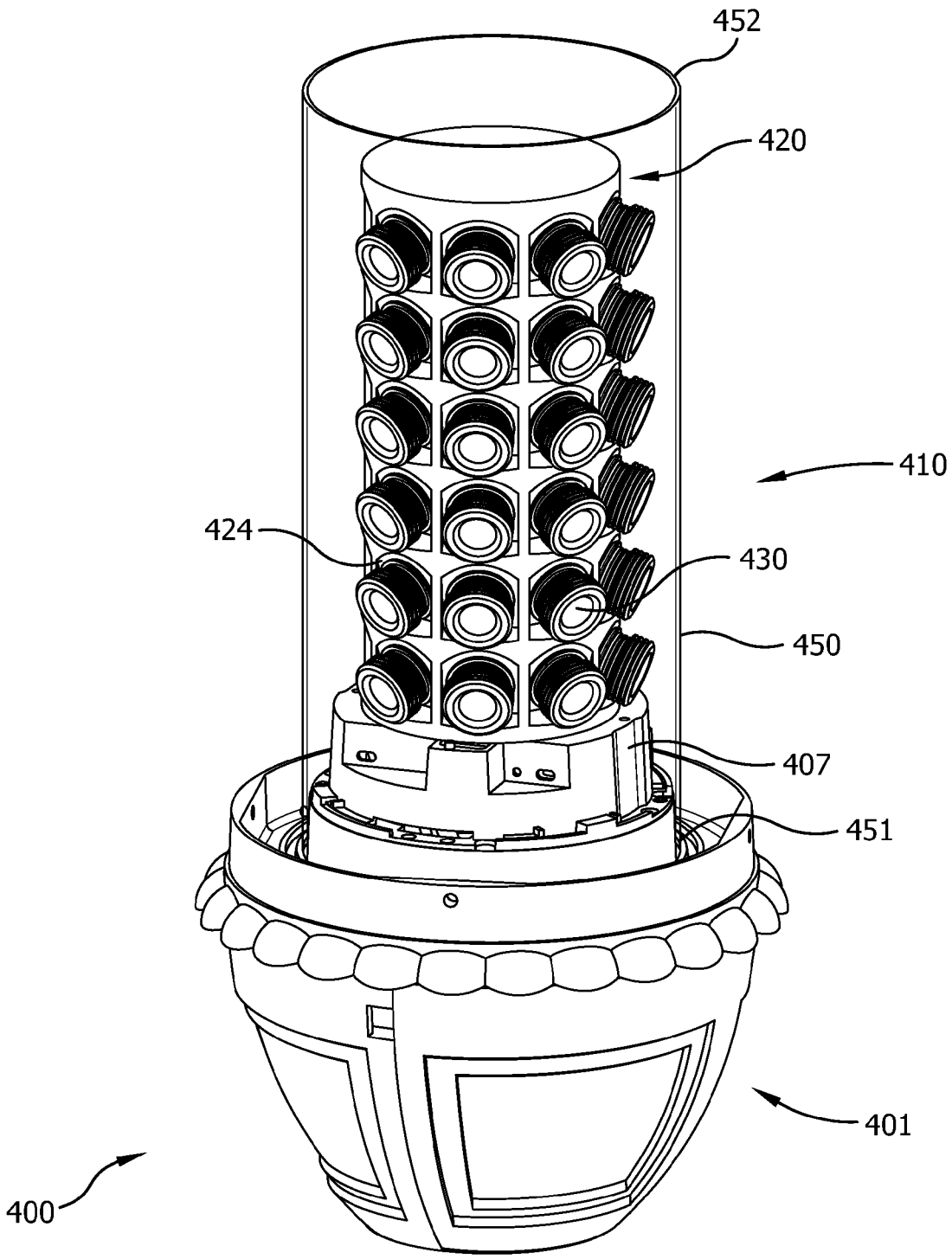
FIG. 8 illustrates a post-top lighting fixture having a fourth embodiment of a LED-based lighting unit installed therein.

Referring to FIG. 8, a fourth embodiment of a low-glare LED-based lighting unit 410 is shown installed in and forming part of a post-top lighting fixture 400. A globe is not shown with post-top lighting fixture 400 for ease in viewing LED-based lighting unit 410. The LED-based lighting unit 410 is similar to LED-based lighting unit 110, but has a single integrally formed vertically extending support structure 420 having a plurality of mounting surfaces 424 thereon. The mounting surfaces 424 are aimed generally toward an illumination area and an LED node 430 is attached to each of the mounting surfaces 424. The vertically extending support structure 420 may optionally contain heat dissipating structure in an interior portion thereof and may optionally include one or more airflow channels in an interior portion thereof.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Reference numerals are provided in the claims merely for convenience and are not to be read in any way as limiting.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

What is claimed is:

1. An LED-based lighting fixture for illuminating an illumination area, comprising:

a vertically extending LED support structure;

an outer housing surrounding said LED support structure, wherein at least a portion of said outer housing allows for the passage of light output therethrough;

an array of individually aimed LEDs coupled to said LED support structure, a plurality of said LEDs having an LED light output axis (A) aimed toward said illumination area;

a plurality of optical pieces, each of said optical pieces mounted over and spaced from a single of said LEDs, intersecting said LED light output axis (A) of a single of said LEDs, and altering a light output distribution of a single of said LEDs; and at least one vertically extending translucent inner lens interposed between a plurality of said optical pieces and said outer housing, said inner lens intersecting said LED light output axis (A) of said plurality of said LEDs at a non-perpendicular angle.

2. The LED-based lighting fixture of claim 1, wherein said vertically extending LED support structure comprises a plurality of vertically extending LED support strips.

3. The LED-based lighting fixture of claim 2, wherein each of said vertically extending LED support strips includes a plurality of offset mounting surfaces generally facing said illumination area.

4. The LED-based lighting fixture of claim 1, wherein said at least one vertically extending inner lens comprises a plurality of vertically extending lens slats.

5. The LED-based lighting fixture of claim 4, wherein said array of individually positioned LEDs includes a plurality of vertically extending columns of said LEDs.

6. The LED-based lighting fixture of claim 5, wherein at least one of said lens slats is interposed between only a single of said vertically extending columns and said outer housing.

7. The LED-based lighting fixture of claim 4, wherein a first inner lens slat of said vertically extending inner lens slats has a first predetermined configuration and a second inner lens slat of said vertically extending inner lens slats has a second predetermined configuration distinct from said first predetermined configuration.

8. The LED-based lighting fixture of claim 7, wherein said first inner lens slat is a different color than said second inner lens slat.

9. The LED-based lighting fixture of claim 6, wherein a first inner lens slat of said vertically extending inner lens slats has a first predetermined configuration and a second inner lens slat of said vertically extending inner lens slats has a second predetermined configuration distinct from said first predetermined configuration.

10. The LED-based lighting fixture of claim 1, wherein said at least one vertically extending inner lens comprises a substantially cylindrical lens, surrounding said LEDs.

11. The LED-based lighting fixture of claim 1, wherein a plurality of said optical pieces are each surrounded by a middle section that also surrounds a single of said LEDs.

12. The LED-based lighting fixture of claim 11 wherein a plurality of said optical pieces are each sandwiched between a portion of said middle section and a portion of a top coupled to said middle section.

13. The LED-based lighting fixture of claim 1, wherein said at least one vertically extending translucent inner lens intersects said LED light output axis (A) of a plurality of said LEDs at an angle between approximately ten degrees and approximately forty-five degrees.

14. The LED-based lighting fixture of claim 1, wherein said at least one vertically extending translucent inner lens intersects said LED light output axis (A) of each of said LEDs at an angle between approximately ten degrees and approximately forty-five degrees.

15. An LED-based lighting unit installable within an outer housing of a post-top street lighting fixture for illuminating an illumination area, said LED-based lighting unit comprising:

vertically extending LED support structure;

an array of individually aimed LEDs coupled to said LED support structure, a majority of said LEDs having an LED light output axis (A) aimed toward said illumination area; and a plurality of vertically extending translucent inner lens slats, each of a plurality of said inner lens slats substantially adjacent a plurality of said LEDs and intersecting said LED light output axis (A) of a plurality of said LEDs at a non-perpendicular angle.

16. The LED-based lighting unit of claim 15, wherein said vertically extending LED support structure comprises a plurality of vertically extending LED support strips and wherein said array of individually positioned LEDs includes a plurality of vertically extending columns of said LEDs.

17. The LED-based lighting unit of claim 16, wherein at least one of said inner lens slats is intersecting said LED light output axis (A) from said LEDs belonging to only a single of said vertically extending columns.

18. The LED-based lighting unit of claim 15, wherein a first inner lens slat of said vertically extending inner lens slats has a first predetermined configuration and a second inner lens slat of said vertically extending inner lens slats has a second predetermined configuration distinct from said first predetermined configuration.

* * * * *